US008585046B2

(12) United States Patent
Herrmann et al.

(10) Patent No.: US 8,585,046 B2
(45) Date of Patent: Nov. 19, 2013

(54) HORIZONTAL SENSOR AND VARIABLE PATTERN FOR DETECTING VERTICAL STACKER POSITION

(75) Inventors: Douglas K Herrmann, Webster, NY (US); Martin E Hoover, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 466 days.

(21) Appl. No.: 12/766,323

(22) Filed: Apr. 23, 2010

(65) Prior Publication Data

US 2011/0260392 A1 Oct. 27, 2011

(51) Int. Cl.
*B65H 31/04* (2006.01)

(52) U.S. Cl.
USPC ..... 271/213; 271/207

(58) Field of Classification Search
USPC ..... 271/207, 213, 214, 217; 356/615–622; 250/224, 231.13–231.18; 73/431
See application file for complete search history.

(56) References Cited

U.S. PATENT DOCUMENTS

| | | | | |
|---|---|---|---|---|
| 5,188,353 | A | 2/1993 | Parks | |
| 5,261,655 | A | 11/1993 | Keller et al. | |
| 5,409,902 | A | 4/1995 | Carson et al. | |
| 5,476,256 | A | 12/1995 | Fortuna et al. | |
| 5,570,172 | A | 10/1996 | Acquaviva | |
| 5,839,015 | A * | 11/1998 | Faguy et al. | 399/23 |
| 5,842,695 | A | 12/1998 | McVeigh | |
| 6,443,450 | B1 | 9/2002 | Antinora | |
| 6,575,461 | B1 | 6/2003 | Rider | |

FOREIGN PATENT DOCUMENTS

| | | |
|---|---|---|
| JP | 57-67439 | * 4/1982 |
| JP | 2003-330334 | * 11/2003 |

* cited by examiner

*Primary Examiner* — Thomas Morrison
(74) *Attorney, Agent, or Firm* — Ronald E. Prass, Jr.; Prass LLP

(57) ABSTRACT

This invention provides an effective and inexpensive stacker tray assembly apparatus and method for determining an elevator stacker tray location in the assembly. A sensor is attached to the stacker tray so that it is in sensing proximity to a continuous variable slanted shape marker. The marker has measurables therein where the measurables decrease in measurement as they proceed from a bottom of the marker to an upper portion of the marker. The sensor is substantially shorter than a length of the movable elevator stacker tray travel.

9 Claims, 4 Drawing Sheets

HORIZONTAL SENSOR AND VARIABLE PATTERN FOR DETECTING VERTICAL STACKER POSITION

This invention relates to finisher stations and, more specifically, to a stacker assembly used in said stations.

BACKGROUND

While the present invention can be effectively used in a plurality of paper or sheet-handling systems, it will be described for clarity as used in electrostatic marking systems, such as electrophotography. In an electrostatographic reproducing apparatus commonly used today, a photoconductive insulating member may be charged to a negative potential, thereafter exposed to a light image of an original document to be reproduced. The exposure discharges the photoconductive insulating surface in exposed or background areas and creates an electrostatic latent image on the member which corresponds to the image areas contained within the original document. Subsequently, the electrostatic latent image on the photoconductive insulating surface is made visible by developing the image with a developing powder referred to in the art as toner. During development, the toner particles are attracted from the carrier particles by the charge pattern of the image areas on the photoconductive insulating area to form a powder image on the photoconductive insulating area. This image may be subsequently transferred or marked onto a support surface such as copy paper to which it may be permanently affixed by heating or by the application of pressure. Following transfer of the toner image or marking, the copy paper may be removed from the system by a user or may be automatically forwarded to a finishing station where the copies may be collected, compiled and stapled and formed into books, pamphlets or other sets.

As above noted, there are many systems that transport paper or other sheet media after the media is marked or treated. These marking systems could include electrostatic marking systems, non-electrostatic marking systems and printers or any other system where paper or other flexible sheet media or receiving sheets are transported internally to an output device such as a finisher and compiler station or stations.

These electrostatic marking systems have finisher and compilers located at a site after the receiving sheets (paper) have been marked. The stacker tray assembly in these compilers usually comprises a stacker tray, controller sensors and height stack switches. Sheet stacker assemblies are well known in the art such as disclosed in Xerox U.S. Pat. Nos. 5,188,353; 5,261,655; 5,409,202; 5,476,256; 5,570,172; 5,842,695; 6,443,450 and 6,575,461. The disclosures of these Xerox patents are incorporated by reference into this disclosure.

Today, there is no reliable effective and inexpensive cut sheet stacking elevator systems that are capable of continuously measuring the position and direction of the elevator that supports the paper stack.

In some current finishing devices and feeders of printing systems, paper elevator position control generally involves stack height switches, corner sensors, and comb brackets with multiple transmissive sensors/algorithms to determine elevator position and direction.

These methods require an elevator to initialize (home) at some position which is usually at the top or bottom of travel. They measure position in the middle of travel by counting from the home position using stepper motor steps or sensor steps using a linear encoder. Often this process requires the elevator to travel to the bottom (or top) of its range to home, and then to move to the desired intermediate position during printer cycle up. This method takes a long time and several sensors are needed to identify elevator location (limited capability) and elevator motion. None of these designs allow for identifying stacker/elevator location and motion/direction in real time.

As an example, one system uses a comb bracket and 3 sensors to identify motion and upper and lower position only. Relatively expensive sensors are located on the elevator that detects transitions on a "comb bracket" located at the back of the frame.

SUMMARY

By installing a small sensor array such as a CIS (contact Image Sensor) horizontally along with a continuously variable slanted shape such as a triangle, the system can provide both accurate and instantaneous elevator positional data. This solution allows for a low complexity, efficiency and low cost system.

With the sensor array mounted horizontally and using a continuously varying slanted shaped target on the finisher frame, the sensor used can be much shorter than the length of elevator travel. This sensor/target system creates an optical reduction to reduce the sensor size requirement while providing accurate positioning and motion data.

In the prior art, elevator controls consistently rely on encoder type controls (linear or rotary) that limit the ability of a stacker/feeder system to accurately determine its location (without a homing operation) and to determine both motion and location in real time with accuracy. The encoder style designs rely on the intermittent triggering of point sensors that look for transitions in either a linear or rotary segmented target. Because these prior art systems look only at transitions, location is identified by an encoder count. To ensure the encoder counts are accurate, homing is required. In addition, because the motion is detected by transitions, there is a need to confirm motion and not noise in triggering the transition. The elevator must perform the homing operation any time the system has a shutdown or to confirm the elevator has not been moved. Additional sensors are needed to ensure that the elevator does not move past the upper or lower limits.

Ideally, in the present invention, array sensors (CIS for low cost) are used to identify both elevator motion and location accurately without the need for homing. Absolute location is determined directly from the sensor readout. However, heretofore there was a cost issue with using a single or stitched sensor system able to span the entire elevator travel distance. This distance can be considerable; the present invention solves this issue.

The present invention provides a method for reducing the elevator motion to be detectable by a small CIS sensor such as an A6 (100 mm) or A8 (54 mm). This significantly reduces the cost and complexity associated with using a longer CIS system.

By mounting the CIS on the elevator horizontally and detecting in one embodiment a triangle image (decal) on the frame, the sensor's inherent accuracy can be used to identify location and motion in real time without the expense or complexity associated with using an array sensor capable of spanning the whole range of travel.

The present invention in one embodiment provides an analog based approach in which affixed to a reference structure is a triangular decal or marking. A contact image sensor is mounted horizontally on the movable elevator and detects the width of the triangular marking which is height dependent.

The triangular or other marking has a height at least the equivalent of the distance of travel of the elevator. In this way, a direct measurement of height can be obtained. As earlier noted, any suitable sensor can be used in the present invention; however, a low cost Contact Image Sensor (CIS) is preferably used in this invention. An example (by illustration not limitation) of a sensor is a C16054-IR5S31 sensor obtained from Toshiba. The triangular decal or other suitable markings can be used, such as a slanted line where the bottom location of the line is furthest from a straight imaginary vertical perpendicular line. These markings will be referred to in this disclosure and claims as a "continuously variable slanted shape marker".

The sensor is attached to the elevator and is in sensing contact with the triangular decal so that it can measure shape, color, horizontal lines or plural ("measurables") as the sensor moves vertically along with the elevator along the height of the triangle or other continuously variable slanted shape marker. Each of these measurables will vary as the sensor moves up or down the vertical height of the triangle. The sensor in one embodiment can sense the shape of the triangle which is widest at its bottom portion and narrowest at its top portion. The black color of the triangle will be largest at the bottom of the triangle and less at the small peak of the triangle. The lines in another embodiment are detected by the sensor, the longest horizontal lines at the bottom of the triangle and the shortest at the top of the triangle. The change in pixel intensity is easily sensed by the small sensor as the sensor moves up and down the triangle height or distance (see FIG. 3).

Figure 1:
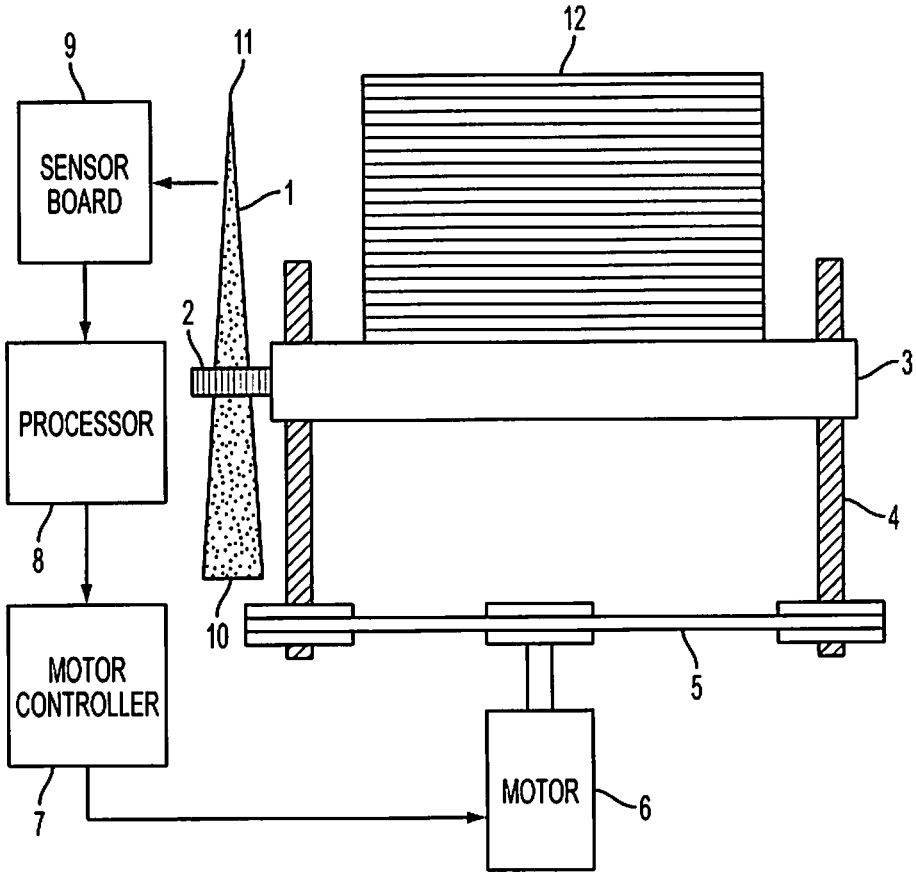
FIG. 1 shows the components of an embodiment of the stacker assembly of this invention using the triangular marking or decal of this invention.

DETAILED DISCUSSION OF DRAWINGS AND PREFERRED EMBODIMENTS,

In FIG. 1 a preferred embodiment of the present invention is illustrated a black (or other measurable color) triangular decal 1 is positioned in sensing relationship with a CIS sensor 2. The sensor 2 is attached or fixed to a movable elevator stacker 3 that moves vertically along stacker lead screw drive shafts 4. A lead screw drive belt 5 is attached to a motor 6 which provides the power to move the elevator 3 up and down. The motor 6 is connected to a motor controller 7, a processor 8 and a sensor board 9. The continuously varying shape triangle decal 1 in this embodiment has measurables of shape and color and characteristics which vary as the sensor 2 moves up the triangle 1; i.e. there is a wider shape at the bottom 10 of the triangle decal 1 than the width of the shape at the triangle top 11. The location of the elevator stacker 3 is easily determined by the sensing of the width and color width as the sensor 2 moves up or down the triangle 1. A paper stack 12 is supported by the movable elevator 3 and its vertical location easily determined by the CIS sensor 2. The decal 1 and CIS sensor 2 can be easily retrofitted into existing stacker assemblies, if suitable. While various measurables have been set out in this disclosure, any other suitable measurable may be used in this invention provided the decal is a continuous variable slanted shape marker and the CIS sensor 2 is attached to the movable elevator 3. The CIS is relatively inexpensive, yet effective in determining elevator 3 position and travel. This sensor 2 creates an optical reduction to reduce the sensor size requirement while providing accurate positioning and motion data. The markers 1 shown in FIGS. 3 and 4A and 4B can be easily substituted for triangle decal 1 of FIG. 1 in the system of this invention.

Figure 2:
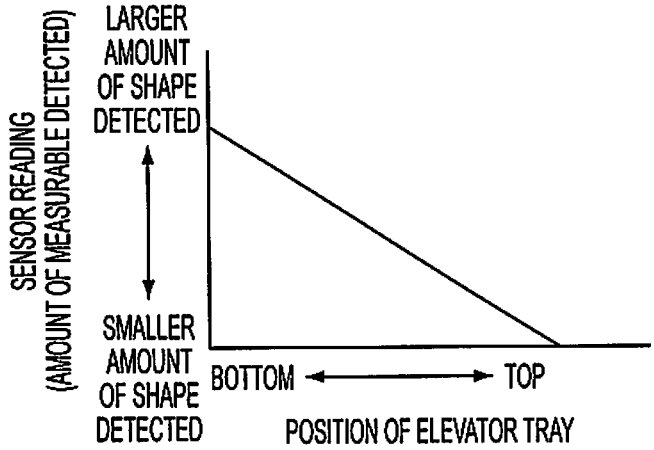
FIG. 2 illustrates an elevator tray position graph showing continuous function measurements.

In FIG. 2 an elevator tray 3 position graph showing continuous function measurements is illustrated, where the amount of shape detected by the CIS 2 is shown. At the bottom 10 of the triangle 1 a larger amount of shape is detected and a lesser amount of shape is detected at the top 11 of the triangle showing the vertical position of the elevator tray 3.

Figure 3:
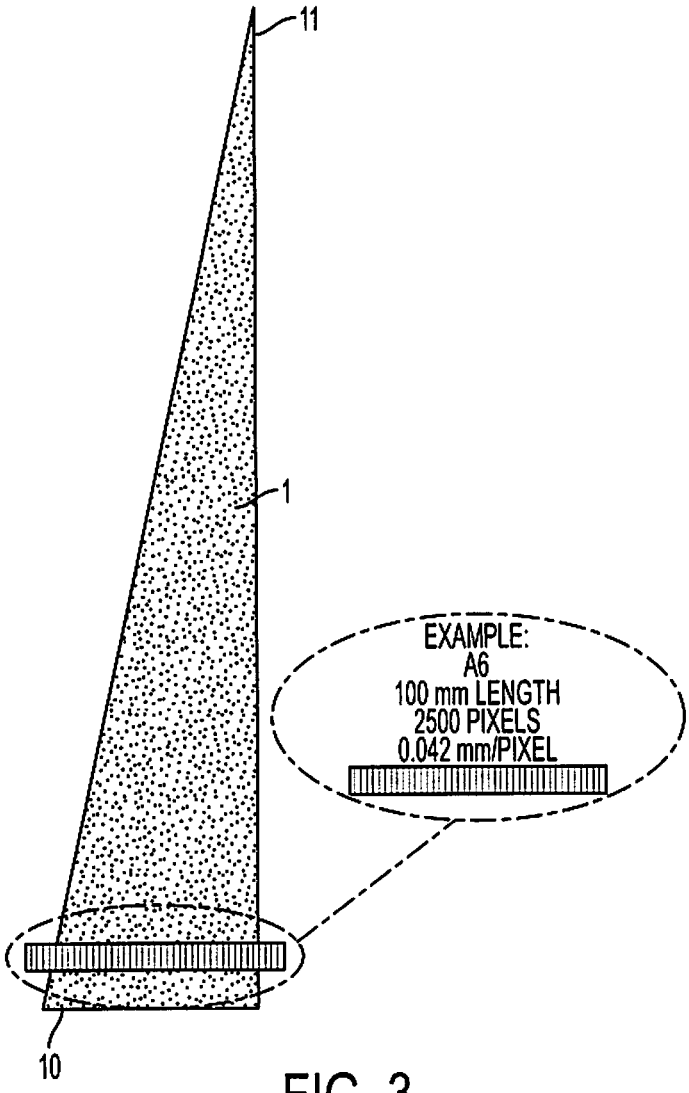
FIG. 3 illustrates an embodiment of this invention where the measurables are pixels in the triangle read by the sensor.

In FIG. 3 a triangle 1 with pixels as the measurables is illustrated. In this example (or FIG. 1) pixel (0.042 mm) change in horizontal dimensions is equal to 0.20 mm vertical travel. The triangle 1 height or elevator 3 travel distance is 479 mm. At the 100 mm base or bottom 10 of the triangle the CIS-2 measures 2500 pixels and 0.042 mm/pixel. At the top pixel is sensed or measured at 0.20 mm vertical travel.

Figure 4A:
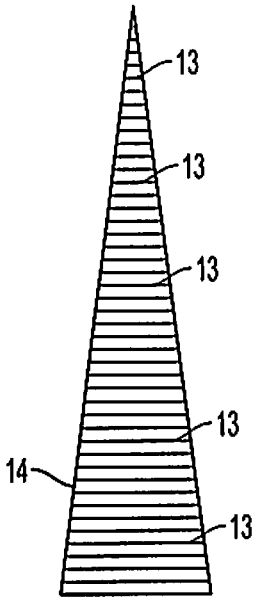
FIG. 4A illustrates an embodiment where horizontal lines are the measurables read by the sensor.
Figure 4B:
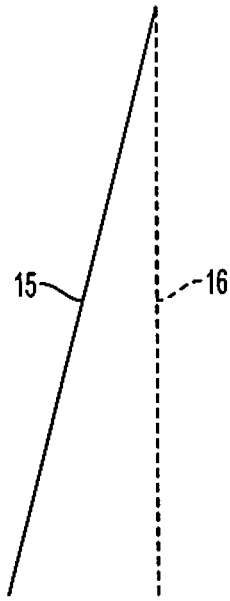
FIG. 4B illustrates a slanted line marking that may be used in place of the triangle. Here, in most instances, line width measurable may be used.

In FIG. 4A a triangle with lines 13 as the measurables is illustrated. The CIS sensor 2 measures the width of each line 13 to determine position of the elevator 3. This decal and that of FIG. 4B can be substituted for the decal 1 of FIG. 1 in the stacker assembly. As each line 13 diminishes in width as approaching the top of lined triangle 14, the sensor 2 conveys this location easily and accurately to the user. FIG. 4B illustrates the slanted line 15 that can be used in place of a triangular decal 1. Here, a line width measurable may be used to determine the distance between line 15 and imaginary vertical line 16. The slanted line 15 and triangle markers 1 comprise continuously variable slanted shape markers of this invention.

In summary, this invention provides a stacker tray assembly positioned in a marking system after a paper or sheet has been marked. This assembly comprises in an operable arrangement a vertically movable elevator stacker tray, at least one sensor attached to an end portion of the stacked tray, a continuously variable slanted shape marker in sensing contact with the sensor. The marker comprises measurables throughout its height. The sensor is configured to indicate a vertical position of the elevator stacker by vertically sensing the measurables in the variable slanted shape marker. At least one sensor is a CIS sensor and the marker in one embodiment is a triangle marker.

The measurables decrease as they proceed from a bottom portion of the continuously slanted shape marker to a top portion of the triangle marker or top portion of the continuously variable shaped marker. It is important to the invention that a size of at least one sensor is substantially shorter than a length of the movable elevator stacker tray travel. At least one sensor is configured to identify both elevator up and down motion and the elevator stack tray location with a stack of sheets thereon. The sensor is configured to directly indicate a vertical position of the elevator stacker tray.

The measurables used comprise those selected from the group consisting of shape, color, horizontal line width and pixels. These measurables decrease in measurement as they proceed up the continuously variable slanted shape marker or up the triangle.

In an embodiment, the invention provides a stacker tray assembly comprising in an operable arrangement a vertically movable elevator stacker tray, a CIS sensor fixed on a side section of the stacker tray and a triangular marker or decal positioned in the assembly where it is in sensing communication with the CIS sensor. The triangular marker has its widest portion or base on a plane parallel with the movable elevator stacker tray. The movable elevator stacker tray is configured to be movable along a distance at least equal to a height of the triangular marker. The triangular marker comprises measurables throughout its height. These measurables are configured to be measured by the CIS sensor. The measurables decrease in measurement as they proceed from a base to an upper portion of the preferred triangular marker. The sensor is configured to indicate a vertical position of the elevator stacker tray by incrementally sensing the measurables in the triangular marker.

It is important that the size of the CIS sensor is substantially shorter than a length of the movable elevator stacker tray travel. As noted earlier, the measurables comprise those selected from the groups consisting of shape, color, horizontal line width and pixels.

The present invention also provides a method of determining a location of a stacker tray in a stacker tray assembly. This method comprises providing an elevator stacker tray in the assembly, loading a stack of sheets on this tray and attaching a sensor at an end portion of the tray in such a manner that the sensor is in a sensing relationship to a continuous variable slanted shape marker. The method comprises providing measurables in the marker so that the measurables: decrease as they approach the top of the marker in a decreasing manner. The measurables are configured to be sensed by the sensor. The method comprises moving the elevator stacker tray wherein the sensor senses the measurables as the elevator moves to thereby directly indicate the location of the stacker tray and the paper stack. The marker is positioned on a finisher frame adjacent the sensor and the marker extends vertically to at least a distance of travel of the elevator stacker. The preferred sensor is a contact image sensor.

The preferred marker is a triangular decal with increased measurables at the bottom of the triangle and progressively less measurables as they approach the top of the triangle. The size of the sensor is substantially shorter than a length of a distance of travel of the movable stacker tray. This is a critically important feature of this invention. Any suitable measurable can be used in this invention such as those measurables selected from the group consisting of shape, color, horizontal line width and pixels. The measurables decrease progressively in measurement as they proceed up the continuous variable slanted shape marker or proceed up the preferred triangular shaped marker.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A stacker tray assembly, comprising:

a vertically movable elevator stacker tray, at least one sensor attached to an end portion of the elevator stacker tray, and a continuously variable slanted shape marker in sensing contact with the at least one sensor, the continuously variable slanted shape marker comprising a plurality of measurables over substantially an entire height of the continuously variable slanted shape marker, wherein the at least one sensor is configured to indicate a vertical position of the elevator stacker tray by vertically sensing at least one of the plurality of measurables of the continuously variable slanted shape marker, a size of the at least one sensor is substantially shorter in a vertical direction than a length that the movable elevator stacker tray travels, and the plurality of measurables consist of one of a plurality of horizontal width lines and a plurality of pixels, the plurality of measurables decreasing in measurement as they proceed vertically up the continuously variable slanted shape marker.

2. The stacker tray assembly of claim 1 wherein the at least one sensor is a contact image sensor, and the continuously variable slanted shape marker is a triangle marker.

3. The stacker tray assembly of claim 1 wherein the at least one sensor is configured to identify both elevator stacker tray up and down motion and the vertical position of the elevator stacker tray.

4. The stacker tray assembly of claim 1 wherein the at least one sensor is configured to directly indicate the vertical position of the elevator stacker tray.

5. A stacker tray assembly, comprising:

a vertically movable elevator stacker tray, a contact image sensor fixed on a side section of said stacker tray, and a triangular marker positioned in sensing communication with the contact image sensor, wherein the triangular marker has a widest portion as a base on a plane parallel with a plane of the elevator stacker tray, the elevator stacker tray is configured to be movable along a distance at least equal to a height of the triangular marker, the triangular marker comprises a plurality of measurables over substantially an entire height of the triangular marker, the plurality of measurables being configured to be measured by the contact image sensor, the plurality of measurables decreasing in measurement as they proceed from the base to an upper portion of the triangular marker in a vertical direction, the contact image sensor being configured to indicate a vertical position of the elevator stacker tray by incrementally discretely sensing at least one of the plurality of measurables in the triangular marker, and the plurality of measurable consist of one of a plurality of horizontal width lines and a plurality of pixels.

6. The assembly of claim 5 wherein a size of the contact image sensor is substantially shorter than a length of elevator stacker tray movement.

7. A method of determining a location of a stacker tray in a stacker tray assembly having a movable elevator, the method comprising:

providing an elevator stacker tray in the stacker tray assembly, loading a stack of sheets on the elevator stacker tray, providing contact image a sensor at an end portion of the elevator stacker tray in a sensing relationship to a continuous variable slanted shape marker, providing a plurality of measurables on the continuous variable slanted shape marker, the plurality of measurables decreasing as they approach a top of the continuous variable slanted shape marker in a decreasing manner, the plurality of measurable being configured to be sensed by the contact image sensor, and moving the elevator stacker tray, wherein the contact image sensor senses at least one of the plurality of measurable as the elevator stacker tray moves to indicate a location of the elevator stacker tray, and the plurality of measurables consist of one of a plurality of horizontal width lines and a plurality of pixels, the plurality of measurables decreasing progressively in measurement as they proceed vertically up the continuous variable slanted shape marker.

8. The method of claim 7 wherein the continuous variable slanted shape marker is a triangular decal with increased measurables at a bottom of the triangular decal and progressively less measurables as they approach a top of the triangular decal.

9. The method of claim 7 wherein a size of the contact image sensor is substantially shorter than a length of a distance of vertical travel of the elevator stacker tray.

* * * * *